United States Patent [19]

Appelbaum

[11] Patent Number: 4,790,163

[45] Date of Patent: Dec. 13, 1988

[54] KEY-WAY COVER

[76] Inventor: Paul Appelbaum, P.O. Box 27006, Denver, Colo. 80227

[21] Appl. No.: 174,151

[22] Filed: Mar. 28, 1988

[51] Int. Cl.[4] ..... E05B 17/18

[52] U.S. Cl. ..... 70/455; 70/55

[58] Field of Search ..... 70/455, 55, 423; 150/52 R, 52 K, 52 L

[56] References Cited

U.S. PATENT DOCUMENTS 2,988,910 6/1961 Eshbaugh ..... 70/455

FOREIGN PATENT DOCUMENTS 1678091 12/1971 Fed. Rep. of Germany ..... 70/455

1147185 6/1957 France ..... 70/455

*Primary Examiner*—Robert L. Wolfe

*Attorney, Agent, or Firm*—Charles C. Corbin

[57] ABSTRACT

A cover for the keyway of a lock comprising a multilayered disk-like lid adapted to allow penetration by a key therethrough, yet being resistant to ingress of environmental contaminants when the key is withdrawn, the lid being rotatably mounted to housing for the lock so as to rotate with a key that has been inserted therethrough for engagement within the keyslot of the lock, the lid having an upper and an intermediate layer of elastomer material, and a bottom support layer of material appreciably less resilient than the upper and intermediate layers. There is a first water impervious slit extending through the upper layer, and a second slit in the intermediate layer that lies in a vertical plan parallel to the first slit and laterally spaced therefrom. A slot in the bottom layer lies below the first and second slits. The first slit is adapted to be deformably opened by the downward passage of a key therethrough. The intermediate layer in turn is adapted to be engaged by the key so that a portion of that layer is deformed and pivotally urged downwardly into the slot of the bottom layer, opening the second slit and allowing the key to pass downwardly through the slot. Retraction of the key allows the protective slits to be resiliently reformed.

11 Claims, 3 Drawing Sheets

Fig. 3
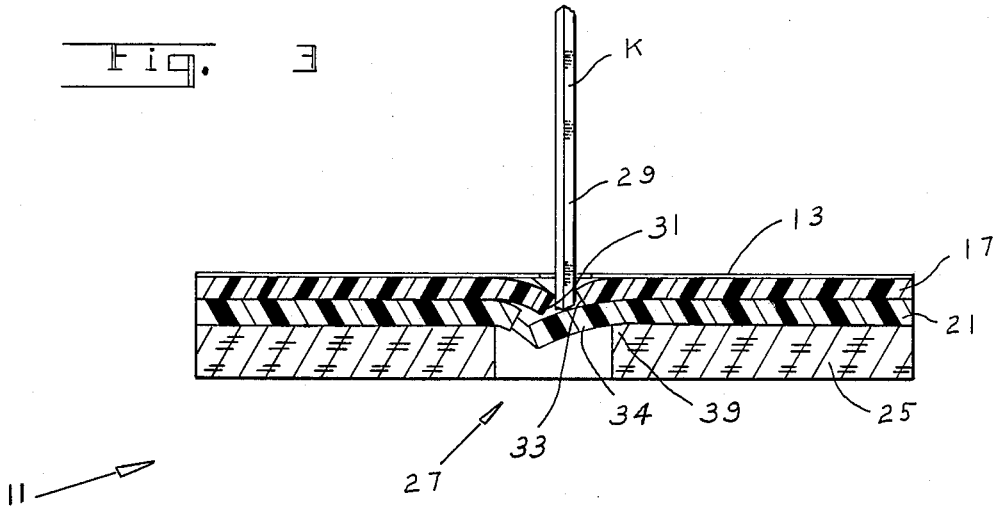
Fig. 4
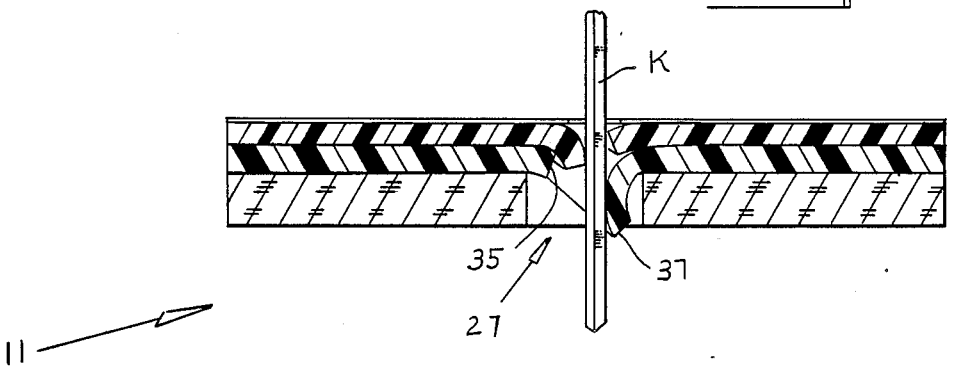
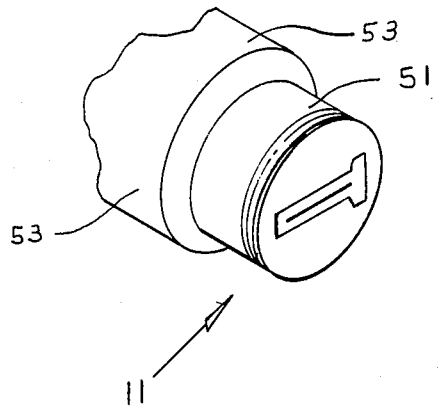
Fig. 8

KEY-WAY COVER

BACKGROUND

The present invention relates to devices for covering and sealing the keyway of a lock, and more particularly to a keyway cover adapted to allow passage of a key therethrough and which automatically returns to a sealing configuration when the key is removed.

The prior art is replete with lock covering devices, such as the padlock jacket shown in U.S. Pat. No. 3,858,419, and the cam-lock cover of U.S. Pat. No. 4,154,072, which devices are intended to keep the lock and its mechanisms free of dust, moisture, mud, and other environmental contaminants. In most cases, in order to seal the keyway, there is a cap or a lid which is removed or opened so as to gain access to the key slot of the lock. When used properly such conventional keyway covers may protect the lock as intended, however a major drawback with such constructions is that protection is completely compromised when the keyway cover is negligently left open. These prior devices are also susceptible to failure due to partial or incomplete closure. In addition these prior caps and lids are often difficult to open and close by people with limited dexterity and strength.

SUMMARY OF THE INVENTION

In view of the foregoing and related drawbacks of conventional devices it is an object of the present invention to provide a keyway cover which cannot be negligently left open.

Another object is to provide a keyway cover which allows the passage of a key therethrough and which returns to a sealing configuration when the key is withdrawn.

A further object is to provide a keyway cover which is not susceptible to partial or incomplete closure.

A still further object is to provide a cover which is easy to manipulate and use.

A further and general object is to provide a keyway cover which is effective and dependable and which is proofed against human incompetence and neglect.

These and additional objects and advantages are accomplished by the present invention which comprises a disk-like multi-layered lid having at least three layers; a top layer and an intermediate layer of elastomer material, and a bottom support layer of a material appreciably more rigid than the elastomer layers. A first, moisture impervious slit lies in the top layer and there is a second slit in the intermediate layer, which second slit is generally parallel to the first slit and which lies in a vertical plane that is laterally spaced from said first slit. There is a slot in the bottom layer which is aligned generally below the slits. While the slits normally have a closed, moisture-impervious configuration, the inventive layered construction is such that a downwardly moving key will urge the first slit open and pass through the key. The key will then engage the upper surface of a portion of the intermediate layer and deform and pivotally urge that portion into the slot of the bottom layer creating an opening for further downward passage of the key. Complete retraction of the key will allow the slits to resiliently return to their moisture-resistant configuration.

BRIEF DESCRIPTION OF THE DRAWINGS

FIG. 3 is an enlarged sectional view illustrating the operation of the invention.

FIG. 4 is a view similar to FIG. 3;

FIG. 8 is a view illustrating another application of the cover of the invention.

DETAILED DESCRIPTION

Figure 1:
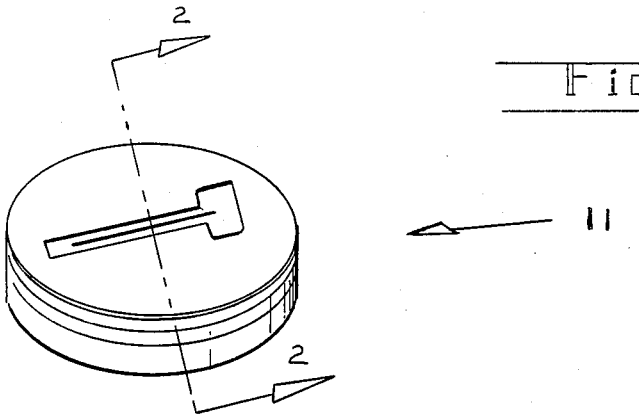
FIG. 1 is a perspective view of a keyway cover according to the invention.
Figure 2:
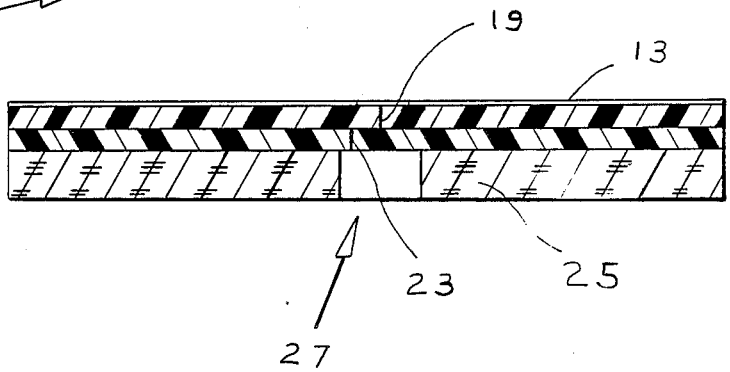
FIG. 2 is a sectional view taken along the line 2—2 of FIG. 1.
Figure 5:
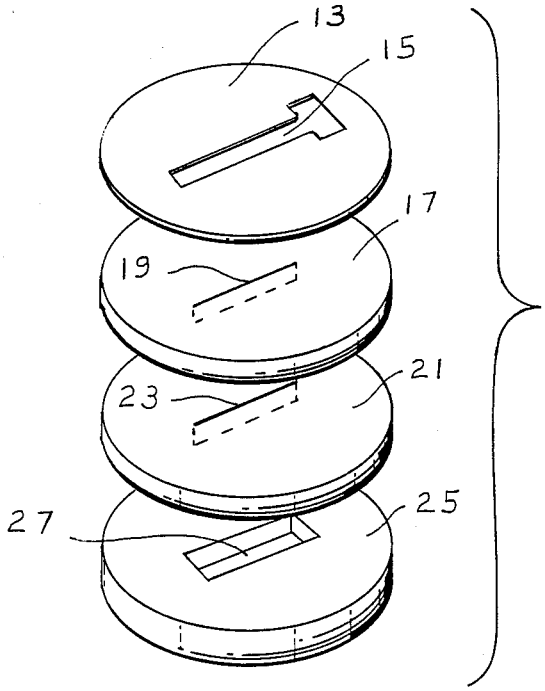
FIG. 5 is an exploded view of the cover of the invention.

FIGS. 1, 2 and 5 illustrate a keyway cover 11 which is constructed according to the invention. Cover 11 has a decorative and protective top plate 13 which is made of a plastic material such as Mylar of PVC. An opening 15 in top 13 is large enough to pass a key stem and preferably has a crowned configuration which indicates the proper orientation of a key to be inserted therethrough. Top 13 is attached by a suitable bonding agent to a first resilient disk 17 which has slit 19 extending therethrough. Disk 17 is constructed of an elastomer material such as a high density microcellular polyurethane, and slit 19 is sufficiently narrow as to prevent ingress of moisture, dust, mud and other environmental contaminants. Disk 17 however is sufficiently resilient to allow the passage of a key stem through slit 19 which will return to its moisture resistant configuration when the key is removed therefrom. Slit 19 preferably lies along the diameter of disk 17 and is aligned along the middle of opening 15 as suggested by FIG. 1.

A second resilient disk 21 is bonded to the bottom of disk 17 and is made of the same material. The slit 23 in disk 21 functions in the same moisture-impervious manner as slit 19. Slit 23 is parallel to slit 19, however it lies in a vertical plane which is laterally spaced from slit 19, as best shown in FIG. 2. Finally there is a bottom support disk 25 which is bonded to disk 21 and which is constructed of a water-resistant material which is appreciably more rigid than the elastomer disks. In the preferred embodiment the support disk 25 is made of a neoprene cork and has a generally rectangular slot 27. Among other things, the disk 25 provides gemeral structural support to the cover 11 while providing an unsupported region above slot 27 which allows portions of the disks adjoining the slits 19 and 23 to be downwardly deformable. Thus it is to be appreciated that disk 27 need not have the specific configuration shown, but may have any of various configurations which will provide the aforedescribed differential support to the elastomer layers.

FIGS. 3 and 4 illustrate how the cover 11 allows the passage therethrough of the stem 29 of a key K. In FIG. 3 the tip of stem 29 has penetrated slit 19 by virtue of engaging portions of disk 17 surrounding the slit 19 and deformably urging those portions downwardly to spread apart the slit edges 31 and 33. FIG. 3 also shows the tip of stem 29 making initial sliding engagement with the top of a portion 34 of the disk 21 which lies above slot 27. Note that the more rigid support disk 25 provides a supporting edge indicated at 39, about which the flap-like portion 34 tends to downwardly pivot. FIG. 4 shows that complete insertion of stem 29 will further deform the portion 34 downwardly into slot 27, and considerably separate the opposing slit edges 35 and 37. When stem 29 is completely withdrawn the resiliency of the disk material will cause slit edges 31 and 33, and 35 and 37 to be rejoined into water impermeable slits 15 and 23 respectively.

Figure 7:
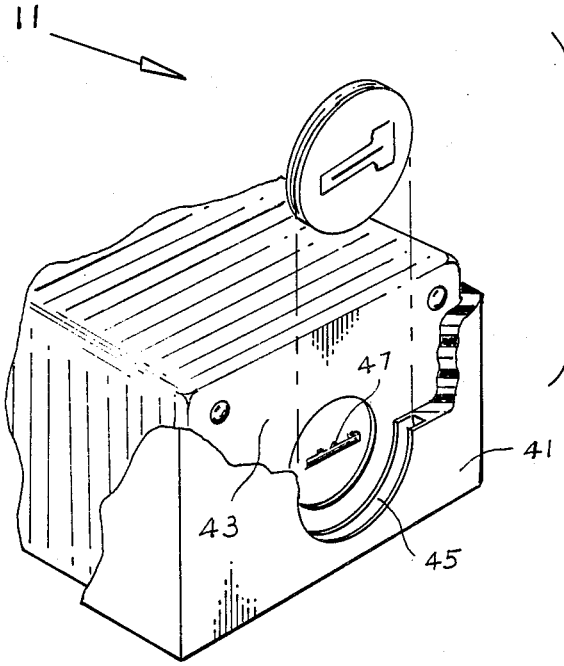
FIG. 7 is a view similar to FIG. 6 with parts broken away for the sake of clarity.
Figure 6:
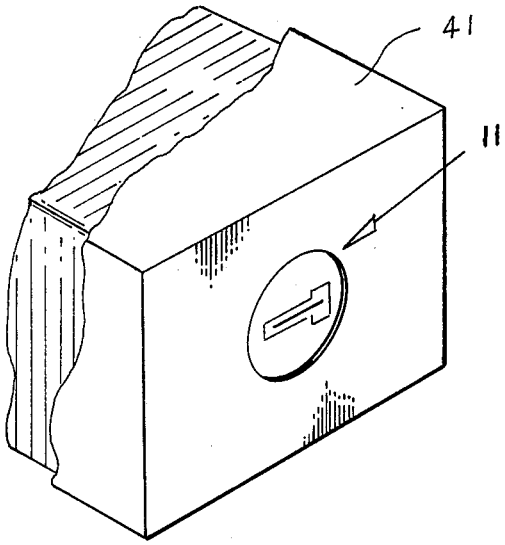
FIG. 6 is a partial perspective view illustrating an application of the invention.

FIGS. 6 and 7 show a keyway cover 11 mounted within an otherwise conventional protective jacket 41 for a lock 43, and adjacent the lock key opening 47. Cover 11 is rotatably and sealingly received within the confines of circular groove 45. It will be appreciated that inner edges of groove 45 wil grasp peripheral portions of the face plate 13 and the support disk 25 with sufficient compressive force to create a seal, yet not too forcefully to prevent cover 11 from being slidingly rotated. When lock 43 is to be opened, the key (not shown) is inserted through the cover 11 in the manner aforedescribed. Prior to the key engaging key opening 47, it is rotated, which action also rotates the cover 11, so that the key is properly aligned with respect to opening 47. The fully inserted key then may be rotated in the usual manner to open the lock 43, with cover 11 rotating with the rotating key. In another application illustrated in FIG. 7, the cover 11 is adhesively attached to the end of a key-receiving lock barrel 51 which is rotatably mounted to lock housing 53. In this example the turning of an engaged key will rotate the barrel 51.

While there has been described a particular embodiment of the invention, it will be obvious to those skilled in the art that various changes and modifications may be made therein without departing from the invention and, therefore it is aimed to cover all such changes and modifications as fall within the true spirit and scope of the invention.

What is claimed is:

1. Cover for the keyway of a lock, said cover comprising a multi-layered key-penetrable structure, including:

(a) upper layer of resilient water-resistant material having a first, water-resistant slit extending therethrough;

(b) intermediate layer of resilient water-resistant material having a second, water-resistant slit extending therethrough, said second slit lying parallel to, and in a vertical plane that is laterally spaced from said first slit; and (c) lower layer of material appreciably less resilient than said upper layer and intermediate layer, and having an opening therein which lies generally below said first slit and second slit, and said lower layer supporting major portions of said intermediate and upper layers against downward deformation while allowing unsupported portions to be downwardly deformable, whereby a downwardly moving key engaging said first slit will downwardly deform said upper layer so as to open said first slit and pass said key, and whereby said key will engage said lower layer and deform it downwardly into said opening thereby opening said second slit to pass said key.

2. Cover as defined in claim 1 wherein said structure has a disk-like configuration.

3. Cover as defined in claim 1 wherein said outer and intermediate layers are disk-like.

4. Cover as defined in claim 1 wherein said opening is a slot.

5. Cover as defined in claim 1 wherein said outer and intermediate layers are of an elastomer material.

6. Cover as defined in claim 1 wherein said first slit lies in a first vertical plane and said second slit lies in a second vertical plane spaced apart from said first plane.

7. Cover as defined in claim 1 wherein said upper, intermediate and lower layers are bonded to each other.

8. Cover as defined in claim 6 wherein said first vertical plane lies at the middle of said opening and said second vertical plane lies near an edge of said opening.

9. Cover as defined in claim 1 including a protective cover lying on said outer layer and having a key-passing slot therein.

10. Cover as defined in claim 2 wherein said structure is rotatably mounted within the walls of a housing structure for said lock.

11. Cover as defined in claim 2 wherein said member is mounted to a rotatable portion of housing for said lock.

* * * * *